United States Patent [19]

Delamere

[11] Patent Number: 4,986,694

[45] Date of Patent: Jan. 22, 1991

[54] MARKER FOR CONCRETE BARRIERS

[76] Inventor: Peter A. Delamere, 227 Balmoral Ave., Toronto, Ontario, Canada, M4V 1K1

[21] Appl. No.: 364,170

[22] Filed: Jun. 12, 1989

[30] Foreign Application Priority Data

Jul. 12, 1988 [CA] Canada ..... 585186

[51] Int. Cl.[5] ..... E01F 9/00

[52] U.S. Cl. ..... 404/6; 404/9

[58] Field of Search ..... 404/6–9, 404/71; 116/63 R, 63 P; 40/612; 256/13.1; 248/225.1, 910, 237, 210, 238

[56] References Cited

U.S. PATENT DOCUMENTS

| | | | |
|---|---|---|---|
| 3,591,144 | 7/1971 | Iving | 404/6 |
| 4,681,302 | 7/1987 | Thompson | 404/6 |
| 4,710,053 | 12/1987 | Kulp et al. | 404/9 |

*Primary Examiner*—Ramon S. Britts
*Assistant Examiner*—Matthew Smith
*Attorney, Agent, or Firm*—Shoemaker and Mattare, Ltd.

[57] ABSTRACT

A marker for concrete safety barriers incorporates a hollow, cylindrical body which is bifurcated from one end to define spaced-apart diverging legs, and an end wall on the other end. Inner walls close the legs and allow them to define pockets which can receive granular material. A reflective sheet material can be affixed to at least part of the exterior. All parts are made of deformable materials such as linear, low-density polyethylene.

9 Claims, 3 Drawing Sheets

MARKER FOR CONCRETE BARRIERS

This invention relates generally to markers for concrete barriers of the kind used extensively in North America on roads and highways.

BACKGROUND OF THIS INVENTION

The use of concrete barriers for the separation of lanes of traffic, or for the separation of traffic from a construction work zone, is wide-spread in North America. The most common type of concrete barrier is based on a design first used in the State of New Jersey, U.S.A. The New Jersey barrier is essentially a reinforced concrete wall composed of units roughly 13 feet in length and 32 inches high. These dimensions are representative only. The barrier profile is designed to deflect vehicles, on impact, back into their lane of the road. Concrete barriers of this type are generally used when the right-of-way of the road is narrow, either due to limitations of the surroundings or due to limitations imposed during road construction.

An important problem attending barriers of the kind just described arises from the fact that concrete tends to blend in with the surroundings due to its daylight colour, and also tends to absorb the light from vehicle headlights at night. In either case it becomes difficult for a driver to determine the position of the barrier.

Because this kind of barrier is typically used when the lane width is reduced, and changes in lane direction are more severe than normal, there is a clear need to enhance the visibility of the barrier.

GENERAL DESCRIPTION OF THIS INVENTION

In view of the above, it is an object of one aspect of this invention to provide a marker for concrete barriers which is shaped so as to straddle the barrier, is weighted so as to remain in place on the barrier despite wind or impact, and is configured in such a way as to provide maximum visibility.

Accordingly, this invention provides, for use in marking the position of concrete safety barriers, a marker comprising:

- a hollow, substantially cylindrical body portion which is bifurcated from one end to define two spaced-apart legs, an end wall closing the non-bifurcated end,
- inner walls closing the bifurcated end in such a way that said inner walls define hollow leg portions with parts of the said body portion, and
- reflective means affixed to exterior of said cylindrical body portion, and located on a part of the body portion facing in the direction of on-coming traffic,
- the body portion and said walls being made of deformable material.

Further, this invention provides, for use in marking the position of concrete safety barriers which are defined in part by two flat, upwardly converging side flanks and an upper surface bridging between the flanks, a marker comprising a hollow, substantially cylindrical body portion made from deformable material, a substantially circular end wall closing one end of said body portion, the other end of the body portion being bifurcated into two leg portions each defined between a cylindrical outer wall and a flat inner wall, the two inner walls converging toward said end wall, the angle of convergence closely matching that of the said two side flanks of a safety barrier, the marker further comprising an inside wall extending between the innermost ends of said inner walls and being substantially the same in length as the width of the upper surface of the safety barrier, granular material within the marker to provide ballast, the end, inner and inside walls being of deformable material, and a light-reflective material affixed to at least a major part of the exterior of the cylindrical body portion including a part thereof which is facing in the direction of on-coming traffic.

GENERAL DESCRIPTION OF THE DRAWINGS

Two embodiments of this invention are illustrated in the accompanying drawings, in which like numerals denote like parts throughout the several views and in which.

DETAILED DESCRIPTION OF THE DRAWINGS

Figure 4:
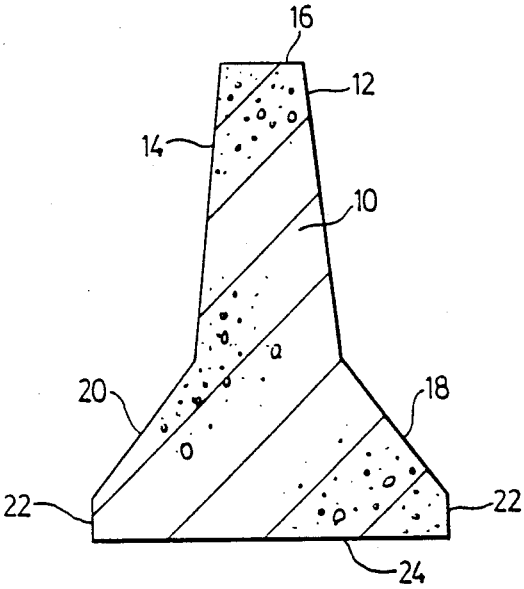
FIG. 4 is a sectional view through a typical concrete barrier with which the marker of the present invention is adapted to be used.

Attention is first directed to FIG. 4, which shows a vertical cross-sectional view through a typical concrete barrier 10. It will be noted in FIG. 4 that the barrier 10 is defined in part by two flat, upwardly converging side flanks 12 and 14, joined at the top by an upper wall 16. At their lower edges, the side flanks 12 and 14 are contiguous with bottom flanks 18 and 20 which in turn are contiguous with marginal bottom portions 22. The barrier 10 has a bottom wall 24 adapted to rest on the surface of a roadway or other terrain.

Figure 1:
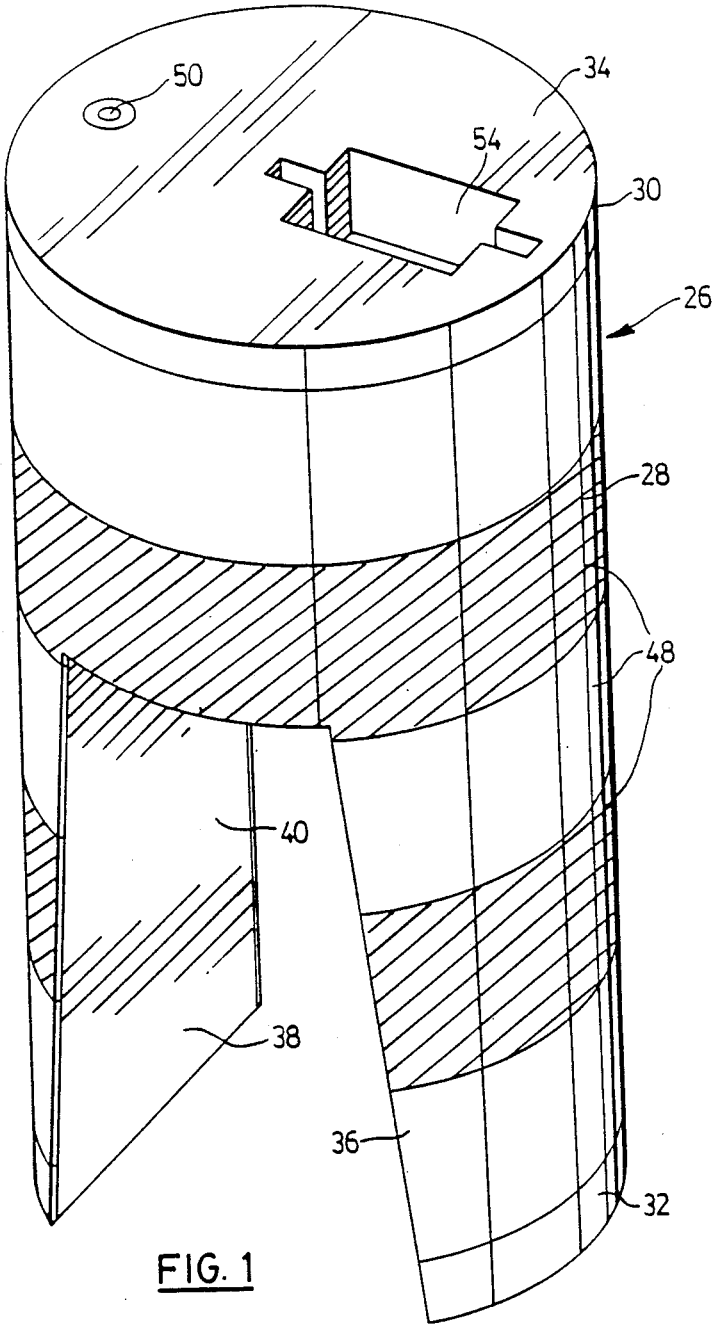
FIG. 1 is a perspective view of a first embodiment of the marker of this invention.

Attention is now directed to FIG. 1, which shows a marker 26 which includes a hollow, cylindrical body portion 28 having an upper end 30 and a lower end 32. A circular end wall 34 closes the upper end 30 of the body portion 28. However, the bottom part of the body portion 28 is bifurcated from the lower end 32 in a bilaterally symmetrical manner to define two spaced-apart legs 36 and 38. More particularly, the bifurcation is defined by two flat inner walls 40 (only one visible in FIG. 1), each inner wall 40 cooperating with a downwardly projecting part of the body portion 28 in order to define a sealed pocket. The sealing of the pocket is completed by bottom walls 42 (not seen in FIG. 1, but visible in FIG. 2).

The embodiment of FIG. 1 also includes an inside wall extending between the innermost (uppermost) ends of the inner walls 40. The inside wall is identified by the reference numeral 44 in FIG. 2, but is shown only in broken lines in FIG. 1 as it is not directly seen in that Figure.

Figure 2:
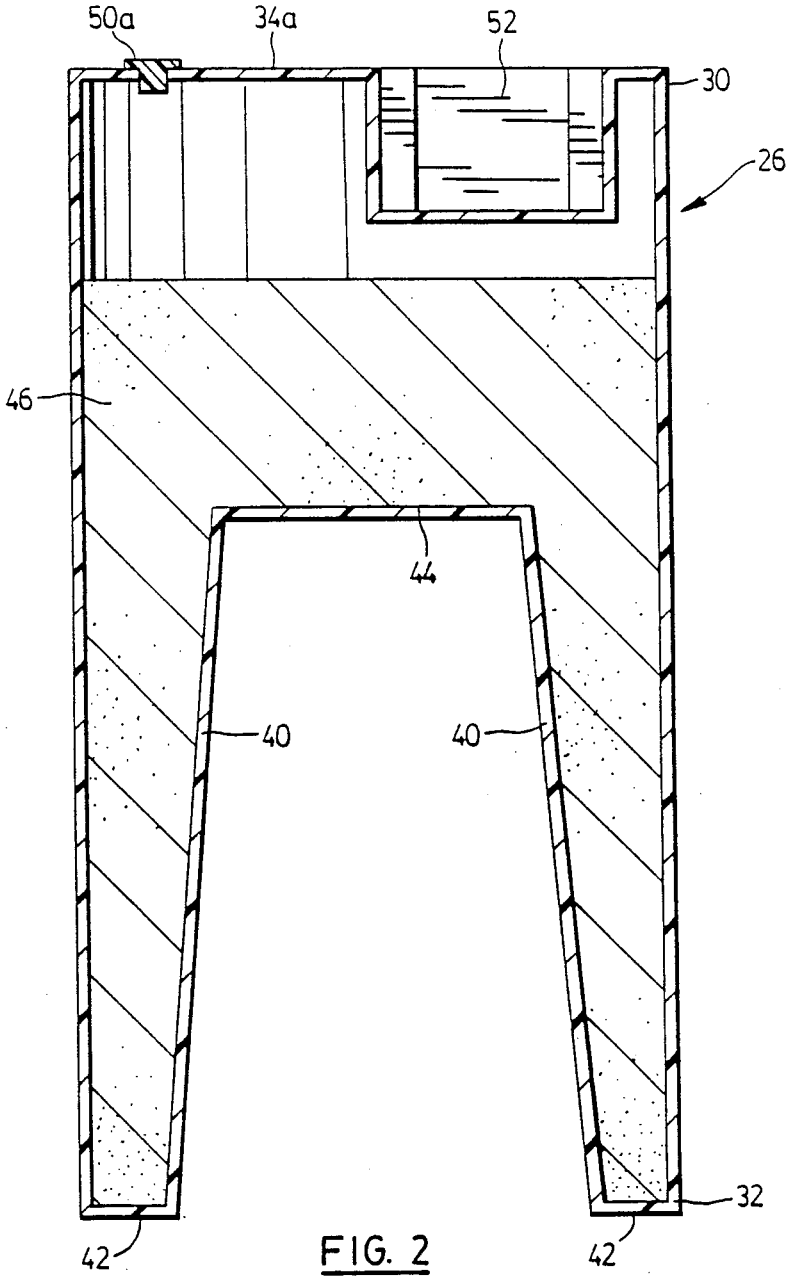
FIG. 2 is a vertical, axial sectional view through a second embodiment of this invention.

The second embodiment of the invention, shown in FIG. 2, differs only in the configuration of the upper end wall, and therefore the remainder of FIG. 2 can serve to illustrate the adaptation of the marker to the barrier profile. Looking at FIGS. 2 and 4, it will be seen that the angle of convergence between the two inner walls 40 closely matches that of the two side flanks 12 and 14 of the barrier 10. Moreover, the left-to-right length of the inside wall 44 (i.e. the dimension measured in the plane of the paper) is substantially the same as the width of the upper surface 16 of the barrier 10 (also measured left-to-right in the plane of the paper). This will allow the marker to sit atop the barrier 10 in the manner of a saddle.

In the preferred embodiment of this invention, the hollow interior of the marker 26 is at least partly filled with granular material 46, which could be gravel, sand or a mixture. This material provides ballast which tends to maintain the marker in place on the barrier, despite wind pressure or impact.

In the preferred embodiment, all of the walls of the marker are made of a deformable material, such as linear low-density polyethylene. It will be evident to those skilled in the art, however, that other materials could also be used.

Returning to FIG. 1, the marker is further characterized by the presence of light-reflective material provided in alternating bands 48 which encircle the cylindrical body portion 28. It will be understood that this configuration of reflective material is illustrative only, and should not be regarded as limiting. Highway and safety requirements vary from place to place and from country to country, and it is intended that the marker 26 have applied to it the kind, colour and configuration of reflective material that falls within local codes and regulations.

In the first embodiment of this invention, shown in FIGS. 1, the circular end wall 34 is provided with a simple plug 50 for filling with granular material.

In the second embodiment of this invention, illustrated in FIG. 2, the upper end wall **34*a* is provided with a plug 50*a* and also with a recess 52** which can serve to support a barricade light or a sign.

Figure 3:
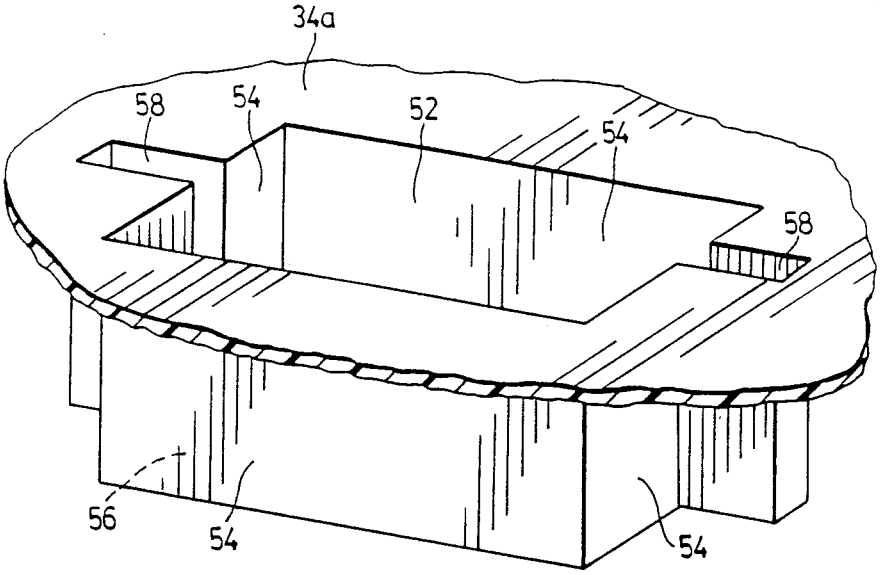
FIG. 3 is a partly broken-away perspective view, to a larger scale, of an upper portion of the embodiment shown in FIG. 2.

Attention is directed to FIG. 3, which illustrates the recess 52 in perspective. As can be seen, the recess 52 is in the form of a rectangular parallelepiped with four rectangular vertical walls 54, a rectangular bottom wall 56, and two slot-like portions 58 extending in opposite directions from the central area of the two opposed end walls 54. The slots 58 are particularly adapted to hold panel-like signs, whereas the major recess 52 can support the lower portion of a barricade light or the like.

It will be noted that the configuration of the marker shown in the drawings allows the light portions to extend down the side of the concrete barrier in order to give maximum visibility with the lowest possible profile. It will be understood that nighttime visibility is provided by light reflected from the vehicle headlights. Under normal driving conditions, the driver is limited to the use of "low beam lights", which means that the lights of the vehicle are pointing downwardly at an angle. In view of this angle of direction, the advantage of having the marker reach as low as possible will be understood.

With regard to the reflective material to be used with this marker, it is found that such material is most effective when its surface is perpendicular to the light source. Such reflective material is typically supplied in sheet form, and thus it will be understood that the surfaces to which the reflective material is applied must be vertical.

A particular advantage of this marker relates to the fact that it is very simple to install and remove. Alternatively, the marker can be permanently installed on the barrier by using an adhesive such as an epoxy or butyl.

Generally speaking, the marker is designed in order to have no effect on the deflecting properties of the concrete barrier. Because the marker is essentially thin-walled, hollow, and made of deformable plastic, it will flatten or distort out of the way when impacted by a vehicle. The use of granular material as ballast will allow such deformation on impact.

It will be understood that the material of the marker itself could be pigmented to any desired colour, depending upon the requirements for various jurisdictions.

While two embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. For use in marking the position of concrete safety barriers, a marker comprising:

a hollow, substantially cylindrical body portion which is bifurcated from one end to define two spaced-apart legs, an end wall closing the non-bifurcated end, inner walls closing the bifurcated end in such a way that said inner walls define hollow leg portions with parts of the said body portion, and reflective means affixed to the exterior of said cylindrical body portion, and located on a part of the body portion facing in the direction of on-coming traffic, the body portion and said walls being made of deformable material.

2. The marker claimed in claim 1, in which the marker contains granular material to act as ballast.

3. The marker claimed in claim 1, in which the separation between the hollow leg portions converges in the direction of the said end wall.

4. For use in marking the position of concrete safety barriers which are defined in part by two flat, upwardly converging side flanks and an upper surface bridging between the flanks, a marker comprising a hollow, substantially cylindrical body portion made from deformable material, a substantially circular end wall closing one end of said body portion, the other end of the body portion being bifurcated into two leg portions each defined between a cylindrical outer wall and a flat inner wall, the two inner walls converging toward said end wall, the angle of convergence closely matching that of the said two side flanks of a safety barrier, the marker further comprising an inside wall extending between the innermost ends of said inner walls and being substantially the same in length as the width of the upper surface of the safety barrier, granular material within the marker to provide ballast, the ned, inner and inside walls being of deformable material, and a light-reflective material affixed to at least a major part of the exterior of the cylindrical body portion, including a part thereof which is facing in the direction of on-coming traffic.

5. The marker claimed in claim 4, in which the end wall includes a sealable filling opening for granular material, and recess means for holding accessories.

6. The marker claimed in claim 4, in which the cylindrical, end, inner and inside walls are all made of linear, low-density-polyethylene.

7. The marker claimed in claim 4, in which said light-reflective material is applied as rings of distinctive colour or reflectivity fully surrounding said cylindrical body portion.

8. The marker claimed in claim 5, in which the cylindrical, end, inner and inside walls are all made of linear, low-density polyethylene.

9. The marker claimed in claim 8, in which said light-reflective material is applied in the form of alternating rings of distinctive colour of reflectivity.

* * * * *